United States Patent [19]

Stahlecker

[11] 3,950,926

[45] Apr. 20, 1976

[54] OPEN-END SPINNING MACHINE WITH A SHIFTABLE APPARATUS FOR START-SPINNING

[75] Inventor: Fritz Stahlecker, Bad Uberkingen, Germany

[73] Assignees: Fritz Stanlecker; Hans Stahlecker, both of Germany

[22] Filed: Sept. 30, 1974

[21] Appl. No.: 510,564

[30] Foreign Application Priority Data

Oct. 10, 1973 Germany ..... 2350840

[52] U.S. Cl. ..... 57/34 R; 57/58.95

[51] Int. Cl.[2] ..... D01H 15/00; D01H 1/12

[58] Field of Search ..... 57/34 R, 58.89–58.95, 57/52, 53, 54

[56] References Cited

UNITED STATES PATENTS

| | | | |
|---|---|---|---|
| 3,608,293 | 9/1971 | Brouwer | 57/34 R |
| 3,810,352 | 5/1974 | Miyazaki et al. | 57/34 R |
| 3,858,385 | 1/1975 | Shinkai et al. | 57/34 R |

*Primary Examiner*—John Petrakes

*Attorney, Agent, or Firm*—Craig & Antonelli

[57] ABSTRACT

To simplify and improve the design, and thus at the same time the maintenance and/or repair possibilities, of an apparatus, which can be shifted longitudinally along an open-end spinning machine, for automatic start-spinning a thread and to additionally achieve more efficient and economical operation of the entire apparatus, the operating devices, control elements necessary for performing individual steps are divided into at least two automatic and largely independently operating groups, with which the entire start-spinning operation is divided into at least two successive parts.

14 Claims, 5 Drawing Figures

127
131
125
124
J
F2
F8
132
F4
123
121
126
122
120
119
118
102
F3
117
116
F7
F5
F6
115
109
110
112
F1
H
106
111
130
129
116a
128
107
A
L
K
114
108
113

127
132
124
125
F10
F9
133
134
N
131
F12
F17
F19
123
135
M
F11
F17
O
F20
122
121
126a
137
F19
F21
F22
136
P
119
F13
120
118
139
141
102
140
117
F16
116
115
128
109
110
F14
112
142
106
138
116a
111
F18
129
107
F15
B
143
114
108
113

OPEN-END SPINNING MACHINE WITH A SHIFTABLE APPARATUS FOR START-SPINNING

The present invention relates to an open-end spinning machine with an apparatus, which can be shifted along a plurality of spinning units, for start-spinning a thread, said apparatus containing a plurality of control elements for performing the the required work.

On an open-end spinning unit, start-spinning a thread, which must be performed to remedy a thread break or when starting the spinning machine, for example, numbers among the most difficult operations, and can thus only be performed by specially trained operating personnel. A number of partially or fully automated start-spinning apparatuses are known for simplifying this work. In a known design (German Laid Open Patent Application No. 2,008,142), there is a fully automated apparatus which can be moved along the open-end spinning machine and which sucks in the broken thread from a winding cone, advances it to the vicinity of a spinning rotor, trims it to a predetermined length, and then inserts it into the spinning rotor. Continuous spinning is then resumed again. In a similar design (German Patent Publication No. 2,012,108), an apparatus which can be shifted along the open-end spinning machine lifts off the winding cone from the winding roller in the event of a thread break, drives it briefly in the unwinding direction, sucks in the broken thread end, grasps this end with a gripper, trims it to a predetermined length, and inserts it into the spinning rotor, whereupon the operating condition is reinstated.

Stationary apparatuses, attached to each spinning unit, are also known (German Patent Publication No. 1,685,908), whose object is to return the broken thread into the rotor before it leaves the rotor housing. However because of the high costs and effort involved, these designs have not been accepted in actual practice, as the spinning operation must nevertheless be interrupted to clean the rotor after a thread break.

The shiftable apparatuses are more advantageous than the stationary apparatuses; however they involve significant design difficulties. Specifically, because of the great number of automatically performed work steps for start spinning, these apparatuses have a high dead weight. Also, since only a limited amount of space is available, the design and arrangement is complicated, with the result that apparatuses of this type can only be maintained or repaired with great difficulty.

It is the object of the present invention to equip an open end spinning machine with an apparatus which is characterized by simple design, thereby providing good maintenance possibilities, as well as troublefree and proper operation. According to the present invention, said control elements are divided into at least two groups, capable of functioning independently, which can be advanced to a spinning unit successively.

The present invention utilizes the advantage that the entire start-spinning operation can be divided into at least two method stages, i.e. in particular in preparatory work, which primarily includes cleaning the spinning rotor, and in the actual start-spinning operation, which primarily includes returning the end of the thread to the spinning rotor and drawing it off again. This design enables the drive and control means of the individual operating elements to be given more space, so that their operation cannot be influenced by other components. It is possible to provide a very neat and orderly and much more easily accessible arrangement, thereby making the apparatus easy to maintain. These advantages at least offset the somewhat higher cost and sophistication for control of the apparatus' feed drive.

In an advantageous development of the invention, the distance between groups corresponds to the distance between spinning units or a multiple thereof. This permits the groups to be employed simultaneously at different spinning units, so that, all in all, much more efficient operation is possible, as a plurality of work steps can be performed simultaneously. For this same purpose, it is also possible to house the groups in units which can be moved separately. This also provides the advantage that the groups are located in units which can be separately moved, while maintaining the advantage of being able to employ the groups simultaneously at any desired spinning units, thereby preventing delays. In a further development of the invention, a plurality of groups with similar control elements are contained in units which can be shifted independently of one another. This takes into consideration the fact that certain work in the overall start-spinning operation is more time consuming than other, so that it might possibly be practical for there to be two or more independently shiftable units, thereby preventing any dead time.

In a further development of the invention, the apparatus contains a receiver, controlling its feed drive, for which each spinning unit has a signal transmitter which responds in the event of a thread break. This ensures that, in the event of thread break, a spinning unit calls for the apparatus to start spinning again. In this connection, it is practical if, for stipulating the sequence of operations, the individual groups are interconnected one with the other by means of control elements which control the feed drive. This ensures that the individual groups are employed successively in the proper location, thereby preventing them from hindering each other.

In a further development of the invention, the group having the control elements for performing the preparatory work has a feed drive which advances it step-by-step, each step corresponding to the distance between spinning units, and is equipped with means for deliberately breaking the thread. This development of the invention is based on the consideration that, in many cases, it can be logical to deliberately break the thread after a certain period of operation and to then clean the rotor and start spinning again, thereby eliminating undesired thread breaks. In actual practice, it can be seen that the undesired thread breaks occur more frequently after a certain period of operation, said thread breaks being caused by fouling inside the spinning unit. Significant advantages can thus be provided by deliberately interrupting the spinning operation and cleaning the spinning rotor, as the number of undesired thread breaks can then be greatly reduced, while, in addition, the start-spinning points caused by the desired thread breaks are located at a predetermined point in the yarn and can therefore be more easily removed if desired.

The above discussed and other objects, features and advantages of the present invention will become more apparent from the following description thereof, when taken in connection with the accompanying drawings, in which.

Figure 1:
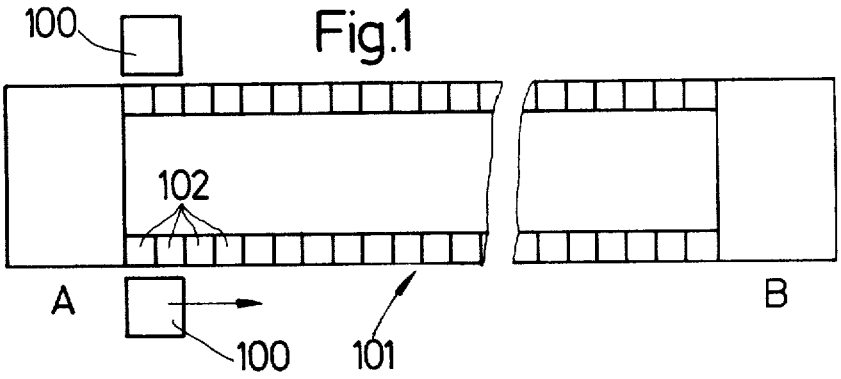
FIG. 1 shows a top view of a schematic representation of a spinning machine with two startspinning apparatuses.

Referring now to the drawings, wherein like reference numerals designate like parts throughout the several views, the embodiment shown in FIG. 1 has one apparatus 100 for start-spinning a thread on each side of a spinning machine 101, having a plurality of spinning points 102 on both sides, said apparatuses 100 being shiftably arranged along spinning machine 101 and designed in such a manner that each is simultaneously associated to two neighboring spinning points 102. The operating elements contained therein for performing the steps necessary for start spinning are divided into two groups, each being capable of functioning independently and performing the successive steps for start spinning. In this connection, it is practical to divide the operating elements into one group for performing the preparatory work and one group for performing the actual start-spinning operation. The preparatory work includes, for example, determining the thread break, interrupting the drive of a winding cone by lifting off the winding cone from a winding roller, opening the spinning unit, cleaning the rotor through mechanical and/or pneumatic means, and closing the spinning unit. Other steps which it is practical to have performed by the group of operating elements for preparatory work are removing the fibre fly at the sliver supply point and opening and cleaning the separating roller housing. This work further includes opening and cleaning dirt chambers and/or blowing out exhausting lines. The operating elements required herefor are combined in one group and arranged in the front section of apparatus 100. This section also includes a receiver which responds to a signal transmitter in spinning point 102, which indicates that there is a thread break at this spinning point 102. The feed drive is controlled accordingly by the receiver in order to ensure that the apparatus reaches the spinning point with the thread break.

Staggered inside apparatus 100 by one division of, i.e. one distance between, spinning units 102 relative to the first group is a second group of operating elements, which perform the steps necessary for the actual start-spinning operation. This includes grasping the thread located on the winding roller, inserting this thread into the apparatus, returning the thread to the spinning rotor, placing the end of the thread on a ring of separated fibres located in the spinning rotor, starting the thread draw-off, lowering the winding cone onto the winding roller associated to each spinning unit and returning the start-spun thread to the thread guiding means of the respective spinning unit. The group containing the operating elements performing the latter steps is arranged inside apparatus 100 in such a manner that it is capable of operating independently. For this, it is practical to have the first group provide a signal to the second group through control means, said signal advancing this second group to the spinning unit in question and putting said second group into operation.

Actual practice has shown that the frequency of thread breaks increases after a certain period of service. This is caused by fouling in the area of the spinning rotor and/or the separating means, which is the reason for a thread break. In order to avoid undesired thread breaks of this type right from the beginning, it is possible to provide apparatuses 100 with means which deliberately cause a thread break, so that it is then necessary to clean or start-spin again thereafter, the advantage of this is that the total number of thread breaks can be significantly reduced, while also being able to improve the quality of the yarn, as thread breaks and start-spinning points are located only at precisely prestipulated points. Means for interrupting the thread can, for example, consist of switching a thread stop-motion, with which the presence of a thread is normally monitored, with the aid of an arm or similar member attached to the apparatus. This thread stop motion normally controls the fibre sliver feed in such a manner that said feed is interrupted in the event of a thread break. If, by changing the setting of the thread stop motion, the fibre sliver feed is interrupted, this will also result in a thread break. It is then practical to equip apparatus 100 with a feed drive which advances one spinning point division at a time, thereby permitting the control element groups to operate at two neighbouring spinning points simultaneously, so that the total time required for cleaning and start-spinning can be significantly reduced without requiring increased machinery or sophistication.

If apparatus 100 is designed for producing deliberate thread breaks, it can be advantageous for productivity to further divide the control element group for performing the preparatory work into two sub-groups, of which one is intended for cleaning the feed and separating means, as well as other auxiliary equipment, for example. It is then also possible to switch the apparatus in such a manner that this group only performs its work every second thread break, as cleaning these components may possibly be of lesser significance. It would then be sufficient for these components to be cleaned every second time the apparatus is employed at a spinning unit or spinning point.

Figure 2:
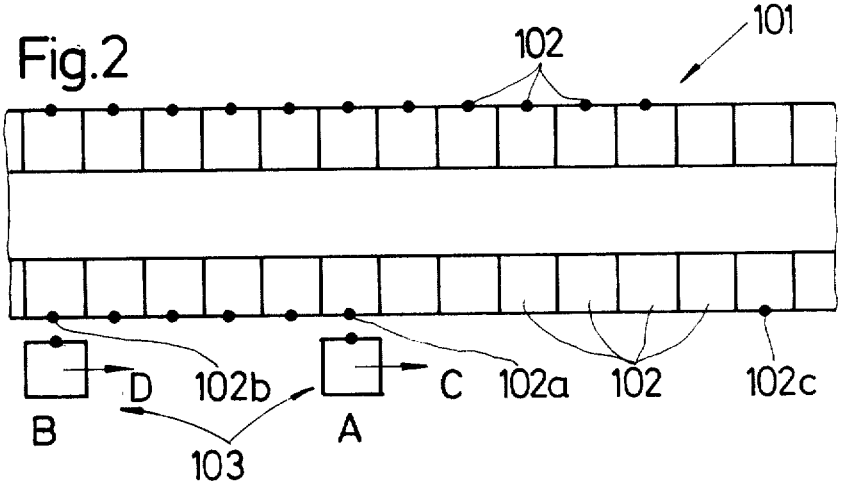
FIG. 2 shows a top view of a spinning machine with a start-spinning apparatus divided into two units.

The open-end spinning machine 101 illustrated schematically in FIG. 2 consists of a plurality of spinning units 102 arranged in a row. An automatic apparatus 103 for start-spinning a broken thread can be shifted longitudinally along open-end machine 101. This start-spinning apparatus 103 consists of two units A and B, which remedy a thread break together. In this connection, unit A performs the preparatory work, to be described in more detail below, for start-spinning, while unit B performs the actual start-spinning operation, to be described below.

It is assumed that there is a thread break at each of spinning units 102*a*, 102*b* and 102*c*, for example. A signal initiated by the thread break causes unit A, which can be shifted longitudinally along open-end spinning machine 101, to stop at spinning unit 102*a* and to perform the preparatory work for remedying the thread break, i.e. for start spinning. This unit A previously performed the same preparatory work for start-spinning at spinning unit 102*b*, and thereupon moved from 102*b* and 102*a*. After completing its work at spinning unit 102*a*, it will continue on in the direction of arrow C and stop at point 102*c* to perform work there also. Unit B, for the actual startspinning operation, advances successively for spinning units 102*b*, 102*a* and 102*c* at a somewhat later time. After unit B has performed its work, the trouble at the respective spinning point is remedied, i.e. the continuous spinning operation is continued.

As can be seen from FIG. 2, while unit A is performing its work at spinning point 102*a*, unit B can perform the start-spinning operation at spinning point 102*b* at approximately the same time. Unit A is caused to go into operation through a thread break signal; unit B is caused to go into operation through a signal provided by unit A. An interlock of any desired type can prevent units A and B from colliding.

Figure 3:
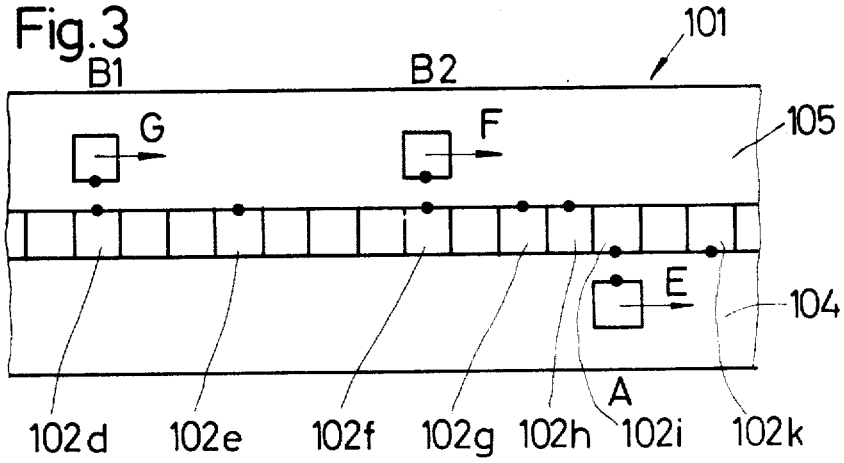
FIG. 3 shows a side view of a spinning machine with a start-spinning apparatus divided into three independent units, arranged at different levels.

The side view of open-end spinning machine 101 (FIG. 3) shows how, for example, two units B1 and B2 can operate conjointly with one unit A. This is practical if the work performance times of the two groups of operating elements differ greatly. To avoid collisions and to reduce the controls required, units A, B1 and B2 travel at different levels 104 and 105. Assuming that there are thread breaks at spinning points 102*d*, 102*e*, 102*f*, 102*g*, 102*h*, 102*i* and 102*k*, unit A advances to all thread break points one after another and performs the preparatory work for start spinning. Unit A has already performed the work at spinning points 102*d*, 102*e*, 102*f*, 102*g* and 102*h*. It is presently performing its work at spinning point 102*i*, and will then travel to spinning unit 102*k* in the direction of arrow E.

The similar units B1 and B2 for the actual start-spinning operation are caused to drive to those spinning points at which unit A already was. In this connection, it is practical to control units B1 and B2 in such a manner that each omits one thread break point, thereby providing good utilization. Thus, it is practical for unit B2, travelling in the direction of arrow F, to first advance to spinning point 102*h* and then to spinning point 102*k*, while unit B1 advances to spinning points 102*e*, 102*g* and 102*i*.

Figure 4:
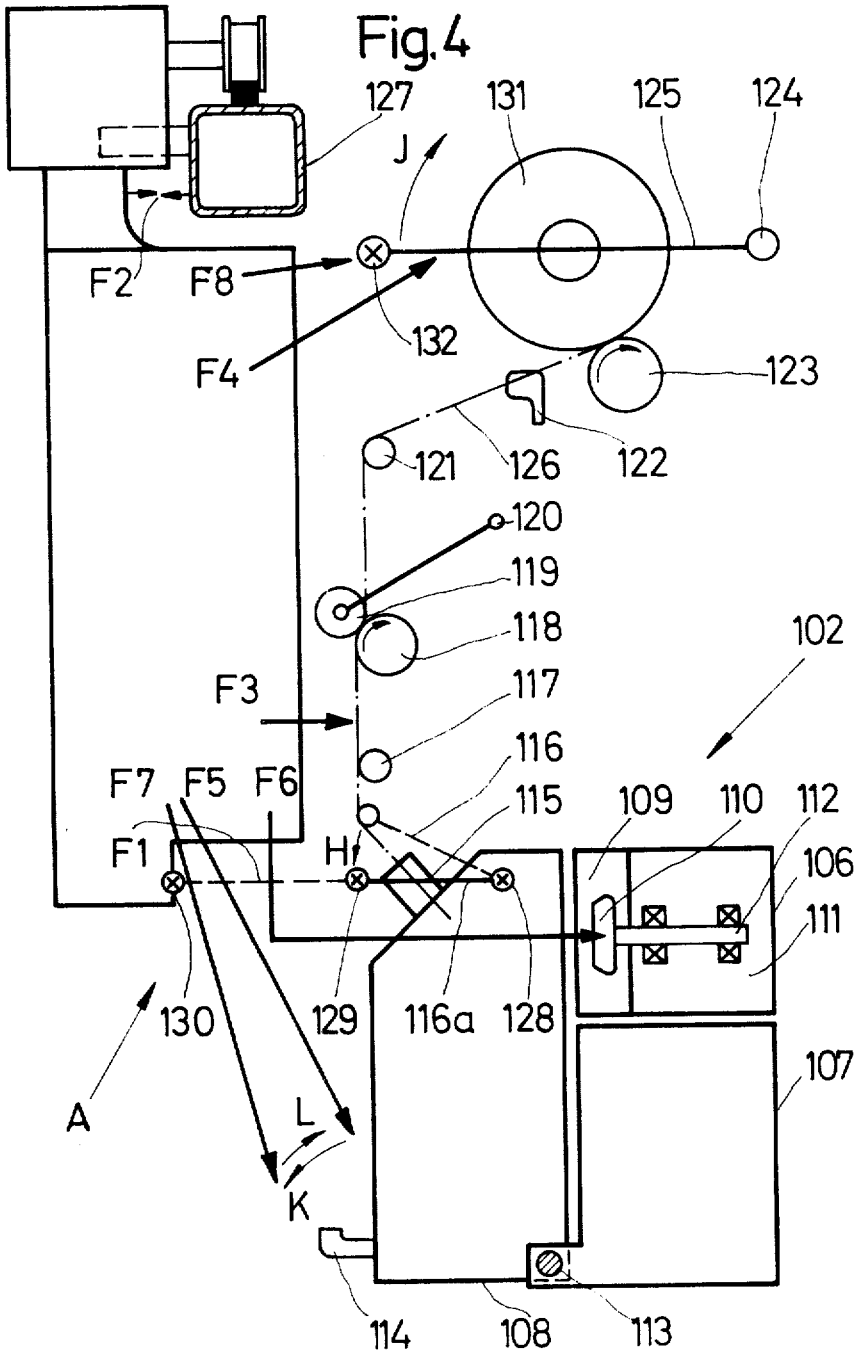
FIG. 4 shows a schematic longitudinal section through an independently shiftable unit having operating elements for the preparatory work.

FIG. 4 shows a schematic cross section of unit A, which performs preparatory work for start-spinning at a spinning unit 102. The operating elements of unit A are represented symbolically in the form of arrows and are designated with F.

Spinning unit 102 has three housings 106, 107 108 and a plurality of shafts and rollers, which will be described in more detail below. Housing 106 contains a spinning chamber 109 with a rotor 110 and a bearing housing 111 for mounting a rotor shaft 112.

Housing 107 contains, primarily, the additional unillustrated drive and accessory equipment, and has a stationary axle 113, about which housing 108, which contains feed and separating means for the fibre sliver to be spun, can be swivelled. Also indicated on swivel housing 108 are a break lever 114 for rotor 110, a yarn delivery channel 115, as well as a dash-dotted thread stop-motion 116. In addition, a deviating roller 117, two draw-off rollers 118 and 119, of which roller 118 is driven, a further deviating roller 121, a traversing thread guide 122, a driven winding roller 123, and a cone arm 125, which can be swivelled about the stationary point 124, are also included in spinning unit 102. The course of the yarn 126 under operating conditions is indicated by a dash-dotted line.

Extending longitudinally along spinning machine 101, of which only one spinning unit 102 is illustrated in FIG. 4, is a stationary rail 127, on which unit A of start-spinning apparatus 103 can be moved. The method of operation of this unit A is as follows:

In the event of a thread break or reduction in tension of yarn 126 as a result of a drop in quality, thread stop-motion 116, attached to spinning unit 102, swivels in the direction of arrow H into position 116*a* (extended line) and stops the fibre sliver feed in a known manner through electrical contacts by means of a switch 128. At the same time, thread stop-motion 116*a* provides a thread break signal, for example through the illumination of a lamp 129. If unit A of start-spinning apparatus 103 now passes by the spinning unit in question at any time, it can be stopped at the spinning unit in question by means of a photoelectric cell 130, for example, and put into operation. It is, of course, also possible to call a stopped start-spinning apparatus to the point in question. The response function to a thread break signal is illustrated symbolically with F1.

In order for unit A to be able to perform the preparatory work required for start spinning, it must first be positioned and adjusted, which is indicated symbolically by two arrows, pointing to one another, with function F2. Instead of responding to a thread break signal (function F1), it is also possible to have unit A travel from spinning point to spinning point, one after the other, and deliberately produce a thread break, which is illustrated symbolically by arrow F3. This measure provides the additional, above mentioned advantages.

After positioning, a control element F4 goes into operation and lifts off cone arm 125 so far in the direction of arrow J that the winding cone 131, which can have greatly differing diameters, will definitely be clear of winding roller 123.

It is practical for cone arm 125 to engage in the lifted off position, so that winding cone 131 remains lifted off when unit A has left spinning point 102 again.

After every thread break, it is generally necessary, but at least advantageous, to clean rotor 110; i.e. to free it of fibre remains and fouling. Housing 108 can be moved away from spinning chamber 109 for this purpose, for example, by being swivelled about axle 113 in the direction of arrow K. The control elements for opening spinning chamber 109 are designated F5. A mechanical and/or pneumatic control element F6 for cleaning rotor 110 then goes into operation. After rotor 110 has been cleaned, housing 108 is swivelled back in the direction of arrow L, so that spinning chamber 109 is closed again (control element F7). Finally, there is also a control element F8, which provides a signal to which the second unit B responds. This can be in the form of the illumination of a lamp 132 located on the raised cone arm 125, for example.

Figure 5:
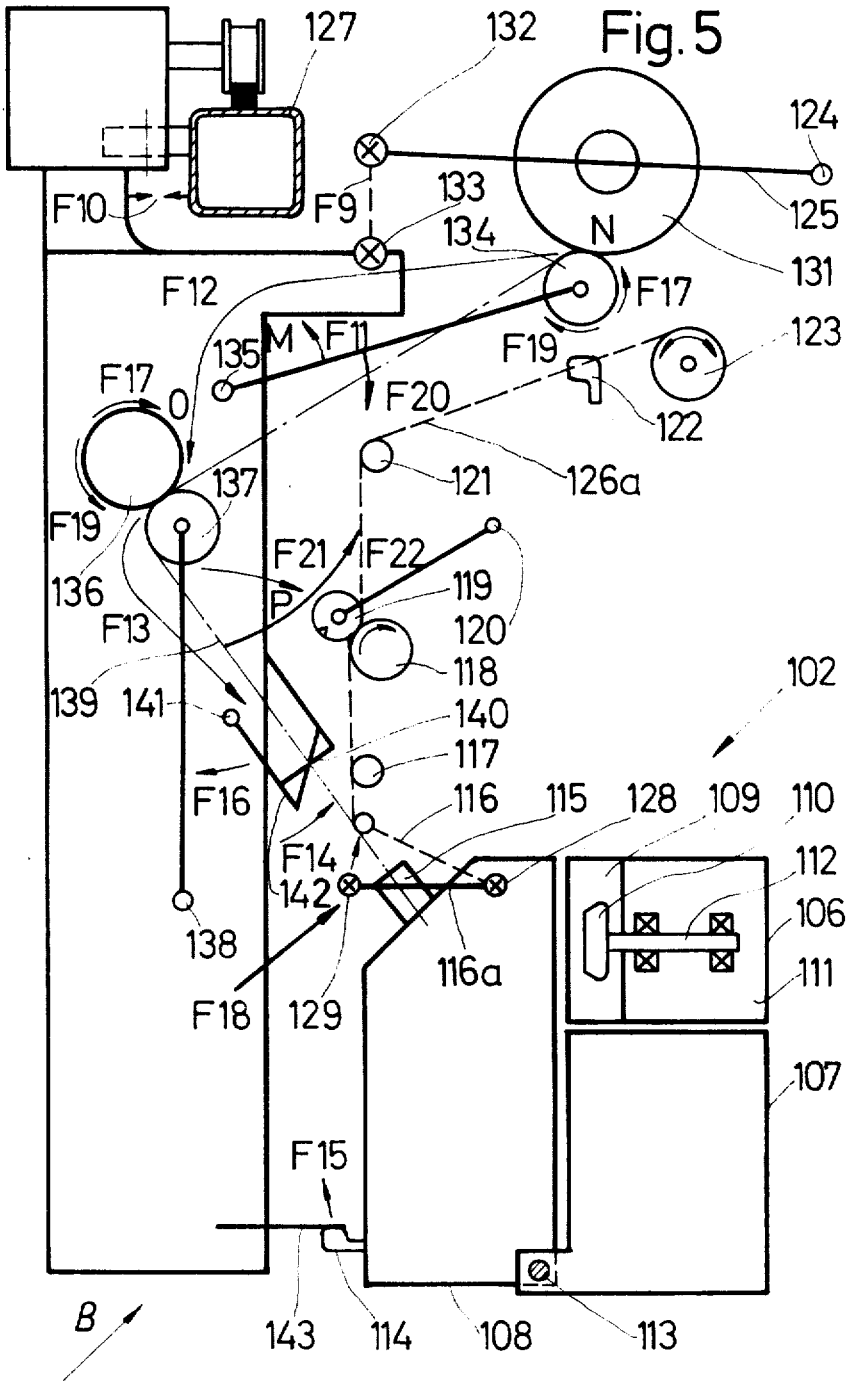
FIG. 5 shows a longitudinal section through an independent unit having the operating elements for the actual start-spinning operation.

After unit A has left the spinning unit 102, where the thread break took place and which has now been prepared for start-spinning, unit B can then go into operation at the same spinning unit at a later time or, in some cases, immediately (FIG. 5). This can be initiated by having a photoelectric cell 133, located on unit B, which is passing by, respond to lamp 132, for example, and stop (control element F9), whereby here also positioning and, if necessary, adjustment (F10) is necessary.

By swivelling a driven lift-off roller 134 in the direction of arrow M about an axle 135 located on unit B, it is possible to lift off cone arm 125 somewhat further than before, thereby disengaging it (function F11). Winding cone 131 is then in a contacting relationship with lift-off roller 134 and can be driven in either direction, as desired. In conjunction with a slight rotary motion of lift-off roller 134 in the direction of arrow N, the broken thread can be sucked onto winding cone 131 by means of a control element F12, grasped and inserted into unit B until the end of the thread comes into a contacting relationship with two draw-off rollers 136, 137. It is practical for draw-off roller 136 to be able to be driven in either direction, while roller 137 is designed as a pressure roller which can be swivelled about an axle 138. With a simultaneous slight rotary motion of lift-off roller 134 in the direction of arrow N and of draw-off roller 136 in the direction of arrow O, a further control element F13 can advance the end of the thread 139 to a thread trapper 140. This thread trapper can contain a lever 142 which can be swivelled about an axle 141 and which can trim thread 139 to a predetermined length, if desired, and then clamp it (function F14).

By means of a coupling member 143 located in unit B, it is possible to then first depress brake lever 114 for rotor 110, which causes rotor 110 to be braked. Brake lever 114 is then released again, so that it rises through the effect of a spring, thereby permitting rotor 110 to start up again. Control element F15 shows that the actual start-spinning operation is initiated by means of a coupling between unit B and the rotor brake, for example by means of lever 114.

For this reason, the end of the thread 139 can be returned to the yarn delivery channel 115 at any desired point in time, i.e. even while the previously braked rotor 110 is returning to its normal operating speed, i.e. at a more or less reduced rotor speed. Thread trapper 140 opens (function F16) with a slight delay after function F15, but before the full operating speed is reached by rotor 110. At the same time, draw-off roller 136 is driven in the direction of arrow O and lift-off roller 134 in the direction of arrow N, causing the thread 139 to be start spun to be returned to yarn delivery channel 115 (control element F17). After initiation of function F17, however prior to attaining the operating speed of rotor 110, a control element F18 returns thread stop-motion **116*a* to the position indicated by the dash-dotted line 116 by swivelling it about axle 128, with the fibre sliver feed to spinning rotor 110 being switched on again in a known, unillustrated manner. As soon as the thread 139 to be start spun has reached a given, adjustable thread tension, draw-off roller 136 and lift-off roller 134 reverse, controlled by unillustrated thread monitoring means, their sense of rotation, causing thread 139 to be drawn out of yarn delivery channel 115, and wound onto winding cone 131 (control element F19). The reversal of the sense of rotation is performed rapidly, with gentle starting with the aid of a special circuit. As soon as lift-off roller 134 has attained a speed which corresponds to the speed of winding roller 123, lift-off roller 134 is lowered about point 135 again (function F20), causing winding cone 131 to come into a contacting relationship with winding roller 123** and be driven without a speed surge.

At the same time winding cone 131 comes into a contacting relationship with winding roller 123, pressure roller 137 is swivelled about axle 138 in the direction of arrow P (function F21). In this manner, thread 139 can be returned from unit B to its dash-dotted operating position **126*a* in spinning unit 102 again by means of a control element F22. When the operating condition has been produced, signals 129 and 132** are extinguished, indicating that the defect has been remedied, so that unit B can advance to the next defect point.

The guide tracks for units 100 and 103 (A, B) can be designed in such a manner that the units travel around the machine, advancing on one side of the machine and returning on the other. However in most cases it will be practical to arrange the units on only one side of the machine. Especially with apparatus 100, it will then be practical for apparatus 100 to travel in one direction, controlled in accordance with individual requirements by an advance drive, and to be returned at high speed to the initial point after it reaches the end of the machine. If a plurality of units A and B are provided, it may be practical to have bypasses on guide rails 127, thereby permitting unit A and B to pass one another. Switches could be employed for this purpose, for example.

Obviously, many modifications and variations of the present invention are possible in the light of the above teachings. It should therefore be understood that within the scope of the appended claims, the invention may be practiced otherwise than as specifically described.

Having thus disclosed my invention, what I claim is:

1. An open-end spinning machine comprising: a plurality of spinning units arranged one beside the other, and at least one apparatus for start-spinning a thread at a respective spinning unit, means for mounting said at least one apparatus on the spinning machine so as to be selectively displaceable to respective spinning units of said plurality of spinning units, said at least one apparatus includes a first means for interrupting the spinning operation of the spinning machine and for preparing the spinning machine for a further spinning operation, and second means for restarting the spinning operation subsequent to the preparation of the spinning machine by said first means, said first means and said second means being independently operable and selectively successively advanced to a respective spinning unit whereby the preparation of the spinning machine for a further spinning operation and the restarting of the spinning machine is performed in at least two independent steps.

2. The open-end spinning machine according to claim 1, wherein said mounting means are arranged longitudinally of said open-end spinning machine, said first means and said second means being arranged on said mounting means adjacent to each other in the longitudinal direction of the spinning machine.

3. The open-end spinning machine according to claim 2, wherein said first means and said second means are spaced from each other by a predetermined distance, said predetermined distance being equal at least to the distance between adjacent spinning units or a multiple of said distance, and wherein a housing means is provided for housing said first means and said second means, said housing means being selectively displaceable along said mounting means to align said first means and said second means with respective spinning units.

4. The open-end machine according to claim 3, wherein sequence control means are provided and are operatively connected with said first means and said second means for controlling the sequence of operation of an entire start-spinning operation, feed drive means are provided and are operatively connected to said first means and said second means for selectively displacing said first means and said second means to a respective spinning unit along said mounting means, and wherein said sequence control means includes control elements for selectively controlling said feed drive means.

5. The open-end spinning machine according to claim 3, wherein said first means includes means for deliberately breaking a thread produced by a spinning unit, and feed drive means for incrementally advancing said first means along said mounting means by a distance corresponding to said predetermined distance between adjacent spinning units.

6. The open-end spinning machine according to claim 1, wherein a first housing means is provided for housing said first means, a second housing means is provided for housing said second means, said first housing means and said second housing means being disposed on said mounting means for independent movement therealong.

7. The open-end spinning machine according to claim 6, wherein a plurality of first means and a plurality of second means are provided, housing means are provided for housing each of said first means and each of said second means independently of one another the respective housing means of said first means and said second means being disposed on said mounting means for independent movement therealong.

8. The open-end spinning machine according to claim 6, wherein said first means includes means for deliberately breaking a thread produced by a spinning unit, and feed drive means for incrementally advancing said first means along said mounting means by a distance corresponding to said predetermined distance between said spinning units.

9. An open-end spinning machine comprising: a plurality of spinning units arranged one beside the other, at least one apparatus for start-spinning a thread at a respective spinning unit, means for mounting said at least one apparatus on said spinning machine so as to be selectively displaceable to respective spinning units of said plurality of spinning units, said at least one apparatus includes a first means for interrupting the spinning operation of the spinning machine and for preparing the spinning machine for a further spinning operation, and second means for restarting the spinning operation subsequent to the preparation of the spinning machine by said first means, said first means and said second means being arranged on said mounting means adjacent one another in the longitudinal direction of the spinning machine and spaced from one another by a predetermined distance, said predetermined distance being equal to at least the distance between adjacent spinning units, and wherein feed drive means are provided for selectively displacing said at least one apparatus along said mounting means, signal transmitter means are provided on each of said spinning units for providing a thread break signal, and receiver means provided on said at least one apparatus for controlling the feed drive means thereof in response to said thread break signal.

10. An open-end spinning machine comprising: a plurality of spinning units arranged one beside the other, at least one apparatus for start-spinning a thread at a respective spinning unit, means for mounting said at least one apparatus on the spinning machine so as to be selectively displaceable to respective spinning units of said plurality of spinning units, said at least one apparatus including a first means for interrupting the spinning operation of the machine and for preparing the spinning machine for a further spinning operation, and second means for restarting the spinning operation subsequent to the preparation of said spinning machine by said first means, a first housing means for housing said first means, a second housing means for housing said second means, said first and said second housing means being disposed on said mounting means for independent movement therealong, and wherein switch means are provided on said mounting means for permitting said first means and said second means to selectively by-pass one another on said mounting means whereby said first means and said second means may be simultaneously operable at different spinning units.

11. The open-end spinning machine according to claim 1, wherein the spinning machine is provided with a plurality of spinning units on both longitudinal sides thereof, said mounting means extending along both longitudinal sides of the spinning machine and around the respective ends of said spinning machine whereby said at least one apparatus is selectively displaceable to said spinning units provided on both sides of said spinning machine.

12. The open-end spinning machine according to claim 10, wherein a plurality of first means and a plurality of second means are provided, housing means are provided for housing each of said first means and each of said second means independently of one another, the respective housing means of said first means and said second means being disposed on said mounting means for independent movement therealong.

13. The open-end spinning machine according to claim 12, wherein each of said first means includes means for deliberately breaking a thread produced by the spinning unit, and feed drive means for advancing each of said first means along said mounting means by a distance at least corresponding to a distance between adjacent spinning units.

14. The open-end spinning machine according to claim 13, wherein the spinning machine is provided with a plurality of spinning units on both longitudinal sides thereof, said mounting means extending along both longitudinal sides of the spinning machine and around the respective ends of said spinning machine whereby said first means and said second means are selectively displaceable to said spinning units provided on both sides of the spinning machine.

* * * * *

UNITED STATES PATENT OFFICE
CERTIFICATE OF CORRECTION

Patent No. 3,950,926 Dated April 20, 1976

Inventor(s) Fritz STAHLECKER

It is certified that error appears in the above-identified patent and that said Letters Patent are hereby corrected as shown below:

Title page as it reads now:

[73] Assignees: Fritz Stanlecker; Hans Stahlecker,

Title page as it should read:

[73] Assignees: Fritz Stahlecker; Hans Stahlecker,

Signed and Sealed this

Twenty-first Day of September 1976

[SEAL]

*Attest:*

RUTH C. MASON
*Attesting Officer*

C. MARSHALL DANN
*Commissioner of Patents and Trademarks*